US008967165B2

(12) United States Patent
Buddharaju et al.

(10) Patent No.: US 8,967,165 B2
(45) Date of Patent: Mar. 3, 2015

(54) WATER INLET FLUSH FOR DISHWASHER FILTER

(75) Inventors: Satish Kumar Raju Buddharaju, Louisville, KY (US); Joel Charles Boyer, Louisville, KY (US); Errin Gnadinger, Louisville, KY (US); Mark Thomas Fryman, Louisville, KY (US); John Dries, Louisville, KY (US); Michael Goodman Schroeder, Louisville, KY (US); Eric B. Devins, Louisville, KY (US); Nicholas Clancy Schooley, Lansing, MI (US)

(73) Assignee: General Electric Company, Schenectady, NY (US)

( * ) Notice: Subject to any disclaimer, the term of this patent is extended or adjusted under 35 U.S.C. 154(b) by 921 days.

(21) Appl. No.: 13/110,308

(22) Filed: May 18, 2011

(65) Prior Publication Data

US 2012/0291821 A1 Nov. 22, 2012

(51) Int. Cl.
*A47L 15/42* (2006.01)

(52) U.S. Cl.
CPC ..... *A47L 15/4208* (2013.01); *A47L 15/4206* (2013.01); *A47L 15/4217* (2013.01)
USPC ..... 134/109; 134/104.1; 134/111; 134/104.4

(58) Field of Classification Search
CPC ..... A47L 15/4208; A47L 15/4202; A47L 15/4204; A47L 15/4206; A47L 15/0039; B01D 29/01; B01D 29/66; B01D 29/668
USPC ..... 134/111, 10, 104.1, 104.4, 109, 110; 210/411, 167.01
See application file for complete search history.

(56) References Cited

U.S. PATENT DOCUMENTS

| | | | | |
|---|---|---|---|---|
| 2,764,169 | A * | 9/1956 | Bazarnic | 134/110 |
| 3,810,480 | A * | 5/1974 | Smith et al. | 134/104.1 |
| 5,711,325 | A | 1/1998 | Kloss et al. | |
| 6,698,438 | B2 * | 3/2004 | Hegeman et al. | 134/110 |
| 6,832,617 | B2 | 12/2004 | Hegeman et al. | |
| 7,431,774 | B2 * | 10/2008 | Kim | 134/18 |
| 7,472,712 | B2 * | 1/2009 | Ashton et al. | 134/104.1 |
| 2003/0024864 | A1 * | 2/2003 | Hegeman et al. | 210/167 |
| 2005/0161392 | A1 * | 7/2005 | Duby | 210/407 |
| 2008/0135067 | A1 | 6/2008 | Mersch et al. | |

* cited by examiner

*Primary Examiner* — Michael Barr
*Assistant Examiner* — Irina Graf
(74) *Attorney, Agent, or Firm* — Dority & Manning, P.A.

(57) ABSTRACT

A fluid filtration assembly for a dishwasher system is described. The dishwasher system includes a tub defining a wash chamber configured to receive dishwasher contents. The fluid filtration assembly includes a filter assembly having a filter material, a filter fluid inlet, and a filter fluid outlet. The filter fluid inlet is in flow communication with the wash chamber and the filter material. The filter assembly further includes a cleaning fluid inlet that is configured to backflush the filter material. The filter fluid outlet is in flow communication with both the cleaning fluid inlet and the filter fluid inlet. The fluid filtration assembly further includes a valve assembly in flow communication with the cleaning fluid inlet through a first flow path.

20 Claims, 5 Drawing Sheets

WATER INLET FLUSH FOR DISHWASHER FILTER

FIELD OF THE INVENTION

The present disclosure relates to a water inlet flush for a dishwasher filter.

BACKGROUND OF THE INVENTION

Conventional dishwasher systems include a main pump assembly and a drain pump assembly for circulating and draining wash fluid, respectively, within a wash chamber defined within the dishwasher system. The main pump assembly feeds wash fluid to various spray arm assemblies for distribution throughout the wash chamber to wash soiled items loaded into dishwasher racks positioned within the wash chamber. Wash fluid sprayed onto the dishwasher items is collected in a sump located in a lower portion of the wash chamber, and water entering the sump is filtered through one or more coarse filters to remove soil and/or sediment from the wash fluid. At least some conventional dishwasher systems further include a filter system in flow communication with the main pump assembly to remove soil and/or sediment of a smaller particle size than those particles filtered by the coarse filters. The main pump assembly draws wash fluid from the sump to re-circulate in the wash chamber, and the coarse and fine filters are used to continuously filter the water in the sump during the re-circulation process.

Such filter systems require periodic removal for cleaning by a consumer in which consumers are expected to remove, clean, and properly reinstall filter components on a regular basis. Unfortunately, problems can occur when consumers fail to maintain filter components on a regular basis. For example, dishwasher performance can be degraded by the presence of excess debris which can obstruct water flow.

Accordingly, a dishwasher filter assembly that decreases the need for consumer interaction would be desirable. A water inlet that is capable of purging a filter assembly while also providing additional functionality would be particularly useful.

BRIEF DESCRIPTION OF THE INVENTION

Aspects and advantages of the disclosure will be set forth in part in the following description, or may be obvious from the description, or may be learned through practice of the disclosure.

In certain embodiments of the present disclosure, a fluid filtration assembly for a dishwasher system is described. The dishwasher system includes a tub defining a wash chamber configured to receive dishwasher contents. The fluid filtration assembly includes a filter assembly having a filter material, a filter fluid inlet, and a filter fluid outlet. The filter fluid inlet is in flow communication with the wash chamber and the filter material. The filter assembly further includes a cleaning fluid inlet that is configured to backflush the filter material. The filter fluid outlet is in flow communication with both the cleaning fluid inlet and the filter fluid inlet. The fluid filtration assembly further includes a valve assembly in flow communication with the cleaning fluid inlet through a first flow path.

In yet other embodiments of the present disclosure, a dishwasher is described. The dishwasher includes a tub defining a wash chamber configured to receive dishwasher contents. The dishwasher further includes a fluid filtration assembly. The fluid filtration assembly includes a filter assembly having a filter material, a filter fluid inlet, and a filter fluid outlet. The filter fluid inlet is in flow communication with the wash chamber and the filter material. The filter assembly further includes a cleaning fluid inlet that is configured to backflush the filter material. The filter fluid outlet is in flow communication with both the cleaning fluid inlet and the filter fluid inlet. The fluid filtration assembly further includes a valve assembly in flow communication with the cleaning fluid inlet through a first flow path.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure, including the best mode thereof, directed to one of ordinary skill in the art, is set forth in the specification, which makes reference to the appended figures, in which.

DETAILED DESCRIPTION OF THE INVENTION

Figure 1:
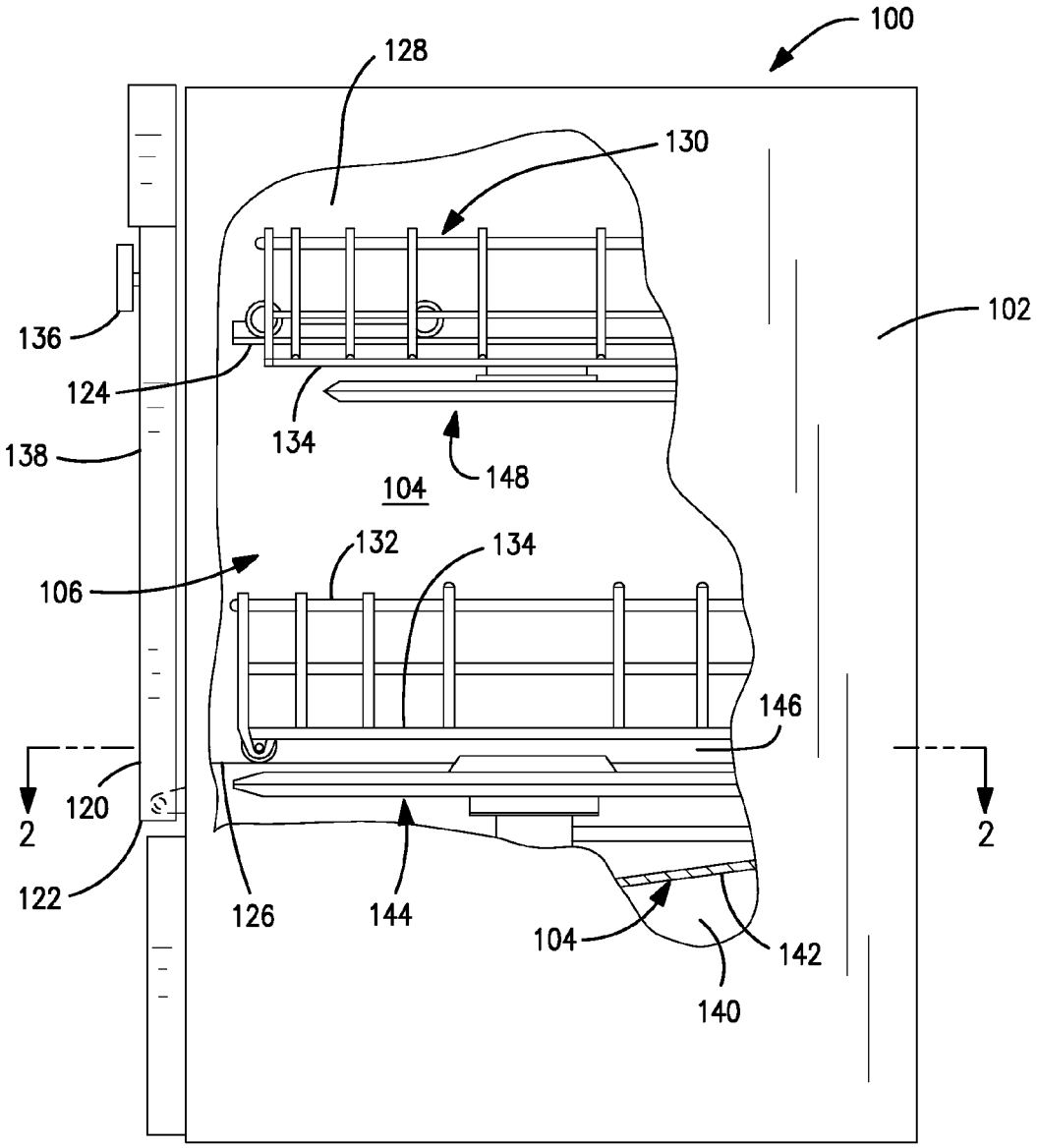
FIG. 1 provides a side elevation view of an example dishwasher system partially broken away in accordance with certain aspects of the present disclosure.

The present disclosure relates to a water inlet flush for a dishwasher filter. Utilization of such a water inlet decreases the need for consumer interaction and can allow for a more efficient draining operation. Advantageously, the water inlet of the present disclosure is also capable of providing additional functionality, such as a dedicated silverware spray. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a side elevation view of an example domestic dishwasher system 100 partially broken away. The flow control mechanism described herein may be practiced in other types of dishwashers and dishwasher systems other than just dishwasher system 100. Accordingly, the following description is for illustrative purposes only, and the flow control is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. In one embodiment, the fluid circulation assembly includes at least one washing water directing device, such as, for example, a spray arm. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
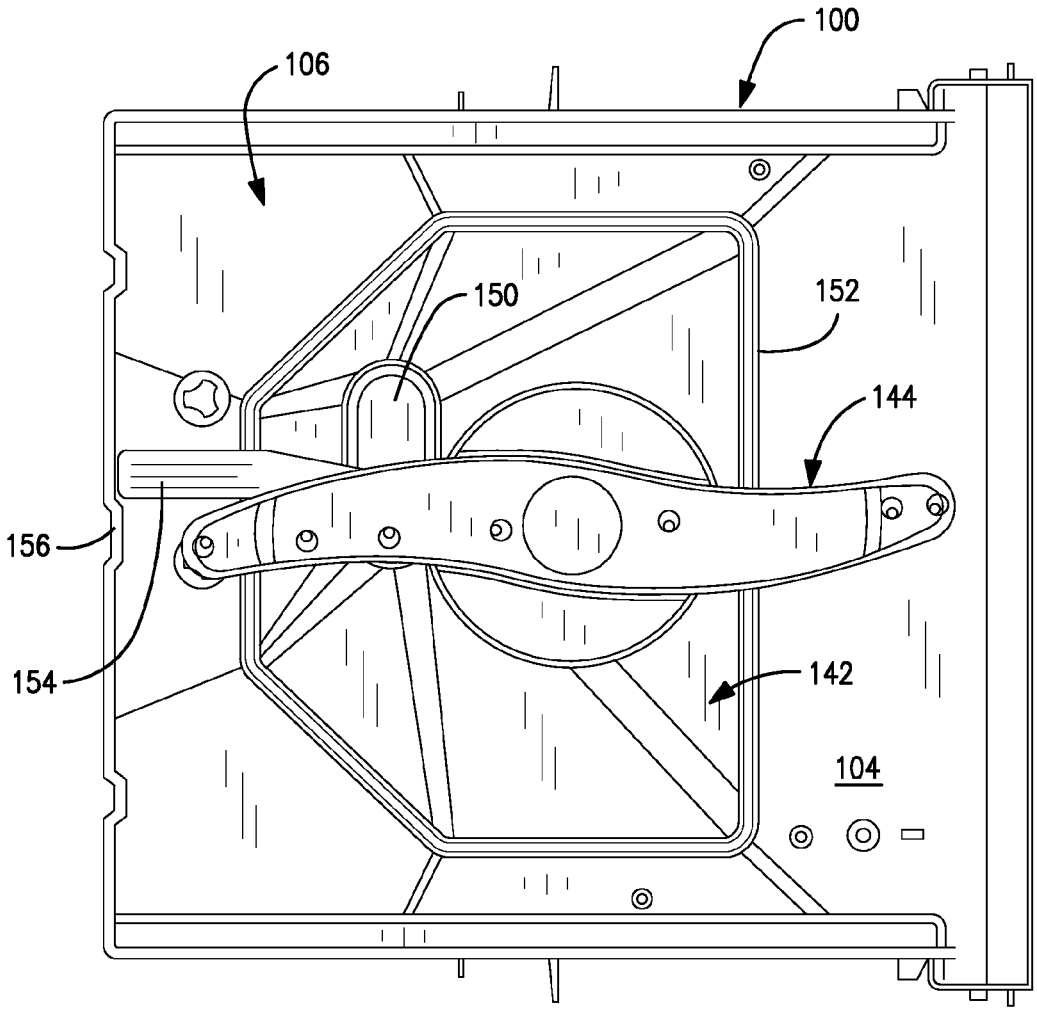
FIG. 2 is a top plan view of a portion of the dishwasher system shown in FIG. 1 along line 2-2 in accordance with certain aspects of the present disclosure.

FIG. 2 is a top plan view of a dishwasher system 100 just above lower spray arm assembly 144. Tub 104 is generally downwardly sloped beneath lower spray arm assembly 144 toward tub sump portion 142, and tub sump portion is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
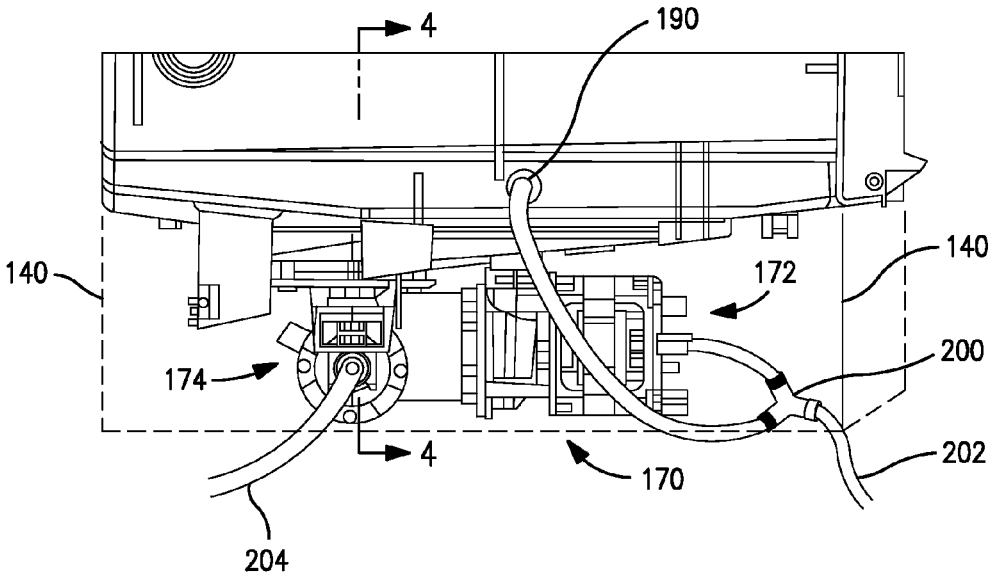
FIG. 3 is a partial side elevation view of the portion of the dishwasher system shown in FIG. 2 in accordance with certain aspects of the present disclosure.

FIG. 3 illustrates fluid circulation assembly 170 located below wash chamber 106 (shown in FIGS. 1 and 2) in machinery compartment 140 (shown in phantom in FIG. 3). Fluid circulation assembly 170 includes a main pump assembly 172. Main pump assembly is in flow communication with inlet flow from water valve 200 which purges filter assembly 190 as is further described herein. Importantly, inlet flow can serve the dual purpose of backflushing the filter assembly 190 while also feeding the dishwasher for the cleaning cycle. Drain pump assembly 174 is in fluid communication with sump 150 (shown in FIG. 2) and a building plumbing system drain pipe 204. While not described in detail herein, flow communication can be provided by hoses, pipes, tubes, or the like as would be understood in the art.

Figure 4:
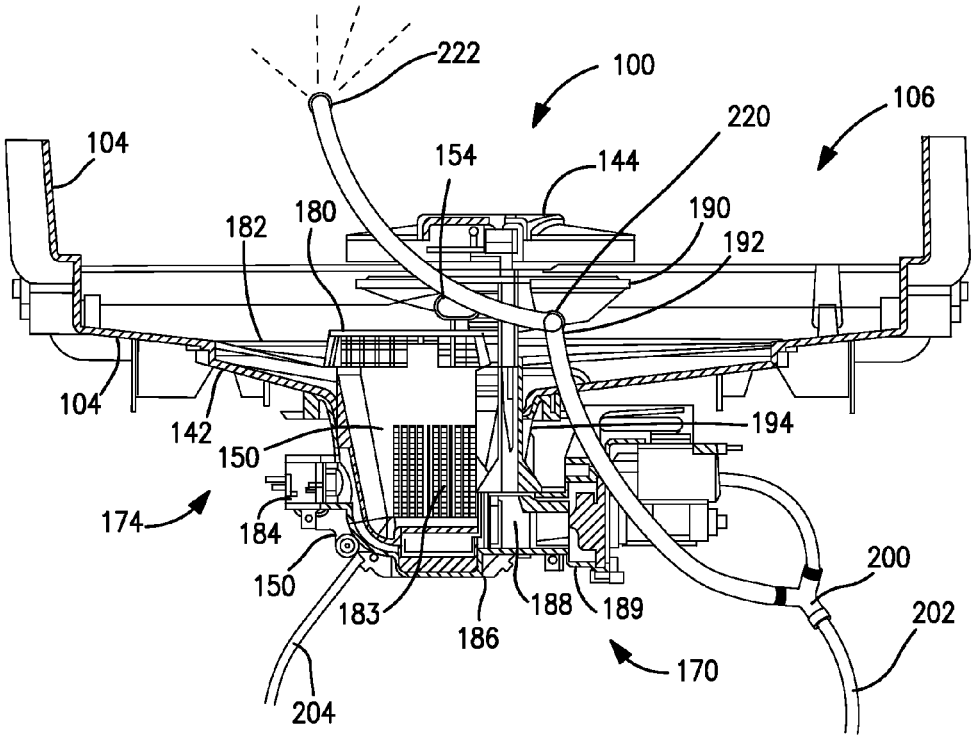
FIG. 4 is a cross sectional schematic view of the portion of the dishwasher system shown in FIG. 3 along line 44 in accordance with certain aspects of the present disclosure.

FIG. 4 is a cross sectional schematic view of dishwasher system 100, and more specifically of fluid circulating assembly 170 through drain pump assembly 174. Tub 104 is downwardly sloped toward tub sump portion 142, and tub sump portion is downwardly sloped toward sump 150. As wash fluid is pumped through lower spray arm assembly 144, and further delivered to mid-level spray arm assembly 148 (shown in FIG. 1) and the upper spray arm assembly (not shown), washing sprays are generated in wash chamber 106, and wash fluid collects in sump 150.

A filter assembly 190 is located in flow communication with sump 150 such as within sump 150 adjacent to tub sump portion 142. As wash fluid is pumped into lower spray arm 144 to generate a washing spray in wash chamber 106, wash fluid drains into filter assembly 190 to filter wash fluid sediment and particles before flowing into sump 150 over tub sump portion 142.

A drain check valve 186 is established in flow communication with sump 150 and opens or closes flow communication between sump 150 and a drain pump inlet 188. A drain pump 189 is in flow communication with drain pump inlet 188 and includes an electric motor for pumping fluid at inlet 188 to a pump discharge (not shown in FIG. 4) and ultimately to a building plumbing system drain (not shown). When drain pump 189 is energized, a negative pressure is created in drain pump inlet 188 and drain check valve 186 is opened, allowing fluid in sump 150 to flow into fluid pump inlet 188 and be discharged from fluid circulation assembly 170.

Figure 6:
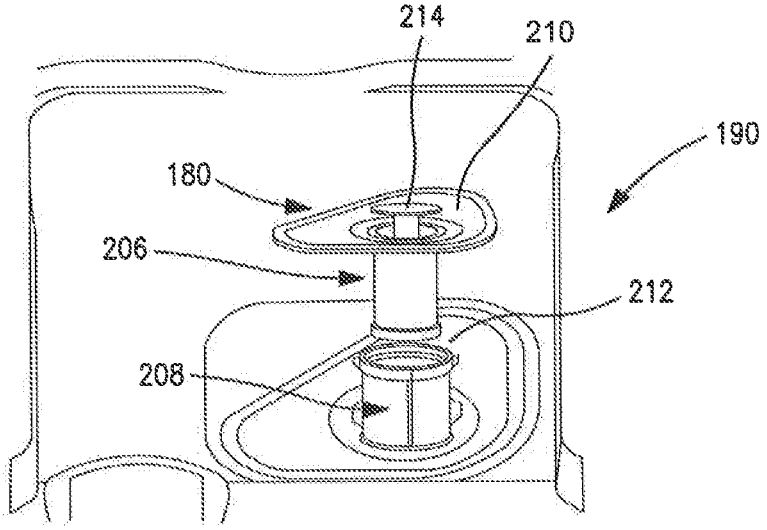
FIG. 6 illustrates a filter assembly in accordance with certain aspects of the present disclosure.

Referring to FIG. 6, a filter assembly 190 in accordance with the present disclosure is illustrated. Filter assembly 190 can include a cover 180 and screen 210 that are generally circular to prevent larger objects from entering sump 150, such as a piece of silverware or another dishwasher item that is dropped beneath lower rack 132 (shown in FIG. 1). Cover 190 can include handle 214 which allows filter assembly 190 to be removed from dishwasher for cleaning. Main body portion 212 has a generally cylindrical shape to aid in channeling the flow of washing fluid across one or more filter screens. In this regard, main body portion 212 can include an outer perimeter coarse filter 208 to filter larger wash fluid sediment and an inner fine filter 206 to filter smaller wash sediment.

During normal operation, wash fluid flows through filter screen 210 into sump 150 and larger food particles from dishes or silverware collect on filter screen 210. Wash fluid is further filtered by coarse filter 208 and fine filter 206 before arriving in sump 150. Filter assembly 190 can be seated in or around sump 150 using any suitable method as would be known in the art such as twist lock or the like so as to allow easy user removal of filter assembly or parts thereof and reinsertion of same.

Figure 5:
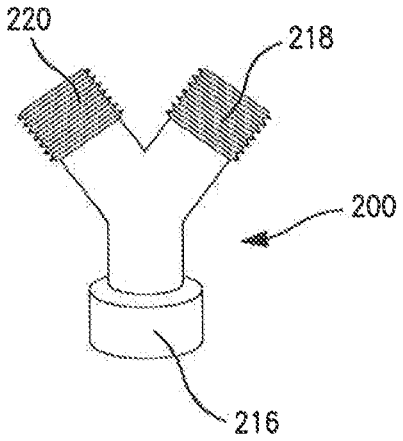
FIG. 5 illustrates a valve in accordance with certain aspects of the present disclosure.

In accordance with the present disclosure, inlet flow from water valve 200 can be utilized to purge filter assembly 190 and minimize user removal and service of filter assembly 190. After passing through filter assembly 190, inlet flow can be utilized to fill dishwasher with water for the cleaning cycle. In this regard, inlet water from a building plumbing system water supply pipe 202 can be split between filter assembly 190 and a separate flow line that can supply one or more sprayers in wash chamber 106 as will be described in more detail herein. For instance, referring to FIG. 5, in certain embodiments of the present disclosure, a y valve can be utilized to direct inlet flow to filter assembly 190. The Y-valve can include an inlet 216 and two outlets 218, 220 adapted to route fluid entering the inlet 216 into the outlets 218, 220 at varying routing ratios as desired. In this manner, flow can be diverted to sprayer(s) without disrupting normal dishwasher operation which receives water flow through filter assembly 190. Water flow to filter assembly 190 can be routed to within filter assembly 190 to backflush filter assembly 190 and clean lodged debris or sediment that can impede fluid flow.

In addition to a y valve, any other suitable water valves are contemplated for use in connection with the present disclosure. For example, valve 200 can be include an actuated valve, such as a solenoid valve, which can send water flow to filter assembly 190 intermittently based on water needs for dishwashing. Such a solenoid valve can be actuated as would be understood in the art by a controller or the like.

In addition to water flow for filter assembly 190, as described previously, water from water valve 200 can also be routed to one or more dedicated sprayers 222 within dishwasher. Sprayer(s) 222 can be of any suitable form as would be known in the art. Flow can be split from the flow paths created by valve 200 to include such sprayer(s). Alternatively, flow can be split by additional valve 220 (illustrated in FIG. 4) to such sprayer(s). Again, any suitable water valve for such purpose is contemplated for use in connection with the present disclosure. For example, additional valve 220 can be include an actuated valve, such as a solenoid valve as described above, which can send water flow to filter assembly 190 and sprayer(s) 222 intermittently. In certain embodiments, water flow from water valve 200 can be direct to sprayers 222.

In certain embodiments, sprayer(s) can be positioned adjacent to one or more silverware baskets to spray silverware with clean water.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fluid filtration assembly for a dishwasher system including a tub defining a wash chamber configured to receive dishwasher contents, the fluid filtration assembly comprising:

a main pump assembly;

a filter assembly comprising a filter material, a filter fluid inlet, and a filter fluid outlet, the filter fluid inlet being in flow communication with the wash chamber and the filter material, the filter assembly defining a normal flow direction wherein wash fluid flows from the filter fluid inlet to the filter fluid outlet; and a valve assembly defining an inlet directly connected with an outside water supply, a first outlet in flow communication with a first flow path, and a second outlet in flow communication with the main pump assembly, wherein the valve assembly is positioned upstream of the main pump assembly as defined by a flow from the outside water supply, and wherein the first flow path is configured to route water directly from the valve assembly to within the filter assembly, such that water from the outside water supply is used to backflush the filter assembly and clean lodged debris or sediment.

2. A fluid filtration assembly as in claim 1, wherein the valve assembly comprises a Y-valve.

3. A fluid filtration assembly as in claim 1, further comprising a second valve configured to split flow from the first flow path between the filter assembly and one or more dedicated sprayers.

4. A fluid filtration assembly as in claim 1, wherein the filter assembly further comprises a cleaning fluid inlet, the cleaning fluid inlet being in flow communication with the first flow path for backflushing the filter assembly, the filter fluid outlet being in flow communication with both the cleaning fluid inlet and the filter fluid inlet.

5. A fluid filtration assembly as in claim 1, wherein the filter assembly comprises a handle and is configured to be removed from the dishwasher by a user for cleaning.

6. A fluid filtration assembly as in claim 1, wherein the wash chamber defines at least a portion sloped towards a sump, and wherein wash fluid flows through the filter assembly in the normal direction before arriving in the sump.

7. A fluid filtration assembly as in claim 1, wherein the filter assembly comprises a filter screen, a coarse filter, and a fine filter, and wherein the normal flow direction of wash fluid through the filter assembly is through the filter screen, through the coarse filter, and through the fine filter.

8. A fluid filtration assembly as in claim 1, wherein the filter assembly comprises a filter screen, a coarse filter, and a fine filter, and wherein the fluid filter inlet is associated with the filter screen, and the fluid filter outlet is associated with the fine filter.

9. A fluid filtration assembly as in claim 1, wherein the first flow path is further configured to route water from the outside water supply to within the filter assembly to backflush the filter assembly and fill the dishwasher with water for a cleaning cycle.

10. A fluid filtration assembly as in claim 1, wherein the inlet of the valve assembly is directly connected with the outside water supply through a fluid conduit.

11. A dishwasher comprising:

a main pump assembly;

a tub defining a wash chamber configured to receive dishwasher contents;

a filter assembly comprising a filter material, a filter fluid inlet, and a filter fluid outlet, the filter fluid inlet being in now communication with the wash chamber and the filter material, the filter assembly defining a normal flow direction wherein wash fluid flows from the filter fluid inlet to the filter fluid outlet; and a valve assembly defining an inlet directly connected with an outside water supply, a first outlet in flow communication with a first flow path, and a second outlet in flow communication with the main pump assembly as defined by a flow from the outside water supply, and wherein the first flow path is configured to route water directly from the valve assembly to within the filter assembly, such that water from the outside water supply is used to reverse a normal flow through the filter assembly and clean lodged debris or sediment.

12. A dishwasher as in claim 11, wherein the valve assembly comprises a Y-valve.

13. A dishwasher as in claim 11, further comprising a second valve configured to split flow from the first flow path between the filter assembly and one or more dedicated sprayers.

14. A dishwasher as in claim 11, wherein the filter assembly further comprises a cleaning fluid inlet, the cleaning fluid inlet being in flow communication with the first flow path for backflushing the filter assembly, the filter fluid outlet being in flow communication with both the cleaning fluid inlet and the filter fluid inlet.

15. A dishwasher as in claim 11, wherein the filter assembly comprises a handle and is configured to be removed from the dishwasher by a user for cleaning.

16. A dishwasher as in claim 11, wherein the wash chamber defines at least a portion sloped towards a sump, and wherein wash fluid flows through the filter assembly in the normal direction before arriving in the sump.

17. A dishwasher as in claim 11, wherein the filter assembly comprises a filter screen, a coarse filter, and a fine filter, and wherein the normal flow direction of wash fluid through the filter assembly is through the filter screen, through the coarse filter, and through the fine filter.

18. A dishwasher as in claim 11, wherein the filter assembly comprises a filter screen, a coarse filter, and a fine filter, and wherein the fluid filter inlet is associated with the filter screen, and the fluid filter outlet is associated with the fine filter.

19. A dishwasher as in claim 11, wherein the first flow path is further configured to route water from the outside water supply to within the filter assembly to backflush the filter assembly and fill the dishwasher with water for a cleaning cycle.

20. A dishwasher as in claim 11, wherein the inlet of the valve assembly is directly connected with the outside water supply through a fluid conduit.

* * * * *